US012791218B2

(12) United States Patent
Van Zee et al.

(10) Patent No.: US 12,791,218 B2
(45) Date of Patent: Nov. 10, 2026

(54) MANUFACTURING FIXTURES INCLUDING AN INTEGRATED DIFFUSER FOR DIFFUSING CONDITIONED AIR

(71) Applicant: Vermeer Manufacturing Company, Pella, IA (US)

(72) Inventors: Daryl Van Zee, Pella, IA (US); Travis Strunk, Eddyville, IA (US); Eric Roggatz, West Melbourne, FL (US); Vanessa Chapman, Pella, IA (US); Matt Paschal, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 863 days.

(21) Appl. No.: 17/919,073

(22) PCT Filed: May 26, 2021

(86) PCT No.: PCT/US2021/034126

§ 371 (c)(1),
(2) Date: Oct. 14, 2022

(87) PCT Pub. No.: WO2021/242789

PCT Pub. Date: Dec. 2, 2021

(65) Prior Publication Data

US 2023/0168002 A1 Jun. 1, 2023

Related U.S. Application Data

(60) Provisional application No. 63/030,744, filed on May 27, 2020.

(51) Int. Cl.
*F24F 13/062* (2006.01)
*F24F 13/08* (2006.01)

(52) U.S. Cl.
CPC ..... *F24F 13/062* (2013.01); *F24F 13/081* (2013.01)

(58) Field of Classification Search
CPC ..... F24F 13/062; F24F 13/081; F24F 3/163; F24F 3/167; F24F 8/00
(Continued)

(56) References Cited

U.S. PATENT DOCUMENTS 2,734,446 A * 2/1956 Name not available ..... F24F 13/062 52/506.08
4,297,940 A * 11/1981 Hainline ..... B23Q 11/08 52/282.4

(Continued)

FOREIGN PATENT DOCUMENTS

DE 1778833 B1 6/1968
DE 3810482 A1 3/1988

(Continued)

OTHER PUBLICATIONS

International Search Report and Written Opinion in International Patent Application No. PCT/US2021/034126, mailed Sep. 24, 2021, 13 pages.

(Continued)

*Primary Examiner* — Avinash A Savani
*Assistant Examiner* — Ryan L Faulkner
(74) *Attorney, Agent, or Firm* — Armstrong Teasdale LLP

(57) ABSTRACT

A manufacturing fixture having an integrated diffuser for diffusing conditioned air into an industrial workspace is disclosed. The fixture includes an elevated platform having an air inlet and a diffuser deck mounted below the platform and disposed below the air inlet. The diffuser deck includes a set of louver plates arranged in a vertical stack. Each of the louver plates of the set has a top surface and an opening (Continued)

wherein the opening of each subsequent louver plate below the uppermost louver plate has an area less than the area of the louver plate directly above. The top surface of each louver plate is angled downward from the opening.

20 Claims, 13 Drawing Sheets

(58) Field of Classification Search
USPC ..... 454/49, 309
See application file for complete search history.

(56) References Cited

U.S. PATENT DOCUMENTS

| | | | | |
|---|---|---|---|---|
| 4,880,581 | A * | 11/1989 | Dastoli | B29C 49/46 425/522 |
| 5,410,120 | A | 4/1995 | Taylor | |
| 6,010,402 | A | 1/2000 | Schmidt | |
| 6,758,875 | B2 | 7/2004 | Reid | |
| 9,644,851 | B2 | 5/2017 | Livchak et al. | |
| 2011/0097989 | A1 * | 4/2011 | McQueeny, Jr. | F24F 13/06 454/289 |
| 2017/0212357 | A1 | 7/2017 | Reid et al. | |
| 2020/0309390 | A1 * | 10/2020 | Perkinson | F24F 13/06 |

FOREIGN PATENT DOCUMENTS

| | | | |
|---|---|---|---|
| DE | 4037287 | A1 | 12/1989 |
| DE | 4417715 | C1 | 5/1994 |
| DE | 19832515 | A1 | 7/1998 |
| EP | 541977 | B1 | 10/1992 |
| EP | 639744 | A2 | 8/1994 |
| EP | 921356 | B1 | 11/1998 |
| EP | 1318360 | A2 | 12/2001 |
| EP | 2661588 | A1 | 11/2013 |
| EP | 3302038 | A1 | 4/2018 |
| GB | 647816 | A | 12/1950 |
| GB | 859890 | A | 1/1961 |
| KR | 100994929 | B1 | 11/2010 |
| WO | 2018167037 | A1 | 3/2018 |

OTHER PUBLICATIONS https://www.pinterest.co.uk/pin/vertical-displacement-ventilation-design-stratified-room-air-quiet-distribution-system-reduced-cooling-capacity-necessary-r--192388215306946962/ published before May 27, 2020.
Titus Accessories, Displacement Ventilation, www.titus-hvac.com, published before May 27, 2020.
Titus Air Diffusers, published before May 27, 2020.
Price Air Diffusers, published before May 27, 2020.
https://www.simscale.com/blog/displacement-ventilation-cfd/ , published before May 27, 2020.
https://www.kemper.eu/en/products/displacement-ventilation_kp18969, published before May 27, 2020.
https://www.youtube.com/watch?v=zP5yYillK2g&t=12s, published Feb. 18, 2015.
Krantz Air Distribution Systems, Displacement Air Outlets, published before May 27, 2020, 12 pages.
https://www.youtube.com/watch?v=qLLPz_ggWlo, published Apr. 13, 2015.
Archiexpo Air Diffuser, published before May 27, 2020.
Artem, "Displacement ventilation in lecture halls", Bachelor's thesis, Mikkeli University of Applied Sciences, Dec. 2012, 38 pages.
https://www.shapeair.com.au/product/aluminium-round-diffuser-low-profile-ardlp/ , published before May 27, 2020.
Waterloo Air Products, published before May 27, 2020.
Niemela et al., "Stratification of Welding Fumes and Grinding Particles in a Large Factory Hall Equipped with Displacement Ventilation", Finnish Institute of Occupational Health, Elsevier Science Ltd., vol. 45, No. 6, pp. 467-471, 2001.
https://www.youtube.com/watch?v=AiXX1ZIF5E8, published Aug. 30, 2017.
RoboVent Spire360 Product Brochure, www.robovent.de, 2 pages, published before May 27, 2020.
https://www.youtube.com/watch?v=h9_Za6acAZM, published Apr. 25, 2014.
RoboVent CrossFlow Table, https://www.robovent.com/air-filtration-equipment/crossflow-table/, Published before May 27, 2020.

* cited by examiner

MANUFACTURING FIXTURES INCLUDING AN INTEGRATED DIFFUSER FOR DIFFUSING CONDITIONED AIR

CROSS-REFERENCE TO RELATED APPLICATION

This patent application is the 35 U.S.C. § 371 national stage of International Patent Application No. PCT/US2021/034126, filed May 26, 2021, which claims the benefit to U.S. Provisional Patent Application No. 63/030,744, filed May 27, 2020, each of which is incorporated herein by reference in its entirety.

FIELD OF THE DISCLOSURE

The field of the disclosure relates to manufacturing fixtures that include an integrated diffuser built within the fixture for diffusing conditioned air into an industrial workspace and, more particularly, manufacturing fixtures that include an integrated diffuser that introduces conditioned air into an industrial workspace by laminar flow to displace contaminated ambient air in the industrial workspace.

BACKGROUND

Industrial workspaces may have open layouts in which one or more industrial operations are performed. At least some known industrial operations produce heat and/or generate fumes and contaminates which pollute the ambient air creating uncomfortable and potentially hazardous conditions within the industrial workspace. Industrial workspaces may include designated work zones (e.g., welding areas), within the open layout. For example, at least some known industrial workspaces have a designated welding zone which includes one or more welding stations for performing a welding operation. Welding operations produce welding fumes and generate heat which substantially warms the ambient air in the welding zone.

Implementing conditioning systems within industrial workspaces has the challenge of exhausting hot contaminated air, generated during an industrial operation, while introducing cooler conditioned air, without mixing the conditioned air with the contaminated air and/or circulating the contaminated air to the surrounding industrial workspace outside of the designated hazardous workspace zone.

Conventional industrial-scale conditioning systems are cumbersome and are difficult to incorporate into industrial workspaces. Industrial workspaces typically have limited available floor space because the workspace is optimized for the industrial equipment needed to complete the industrial operation e.g., the welding station and other welding equipment. Furthermore, conditioning systems implemented in industrial workspaces may require robust components that are capable of withstanding impacts that are prevalent in the environment of an industrial workspace.

A need exists for robust conditioning systems suitable for conditions present in industrial workspaces that are capable of replacing contaminated and hot ambient air with conditioned cooler air while minimizing the footprint of the system.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure.

Accordingly, it should be understood that these statements are to be read in this light, and not as admissions of prior art.

SUMMARY

One aspect of the present disclosure is directed to a manufacturing fixture having an integrated diffuser for diffusing conditioned air into an industrial workspace. The fixture includes an elevated platform supported by frame members. The elevated platform has an air inlet formed therein having an air inlet area. A diffuser deck is mounted below the elevated platform and disposed directly below the air inlet. The diffuser deck is disposed within the frame members. The diffuser deck includes a set of louver plates arranged in a vertical stack. Each of the louver plates of the set has an opening having a centroid and defines an opening plane. The opening of each subsequent louver plate below an uppermost louver plate has an area less than the area of the louver plate directly above. The centroids of each opening of the louver plates are positioned at a generally vertical louver axis. The opening planes are generally perpendicular to the louver axis. Each of the plates has a top surface. The top surface of each louver plate is angled downward from the opening.

Another aspect of the present disclosure is directed to a method of dispelling ambient air containing fumes in an industrial workspace arranged within an open factory. The industrial workspace includes a floor and a roof disposed above the floor. A conditioned air stream is directed from a supply duct to a vertical diffuser having a plurality of louver plates arranged in proximity to the floor. The conditioned air stream is introduced at a velocity less than 150 feet per minute at a distance of 12 inches away from the diffuser by laminar flow into the ambient air containing fumes. Ambient air containing fumes is displaced by the laminar conditioned air flow such that the ambient air containing fumes is displaced in a vertical direction towards the roof. Ambient air containing fumes is exhausted through an exhaust system arranged in proximity to the roof.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
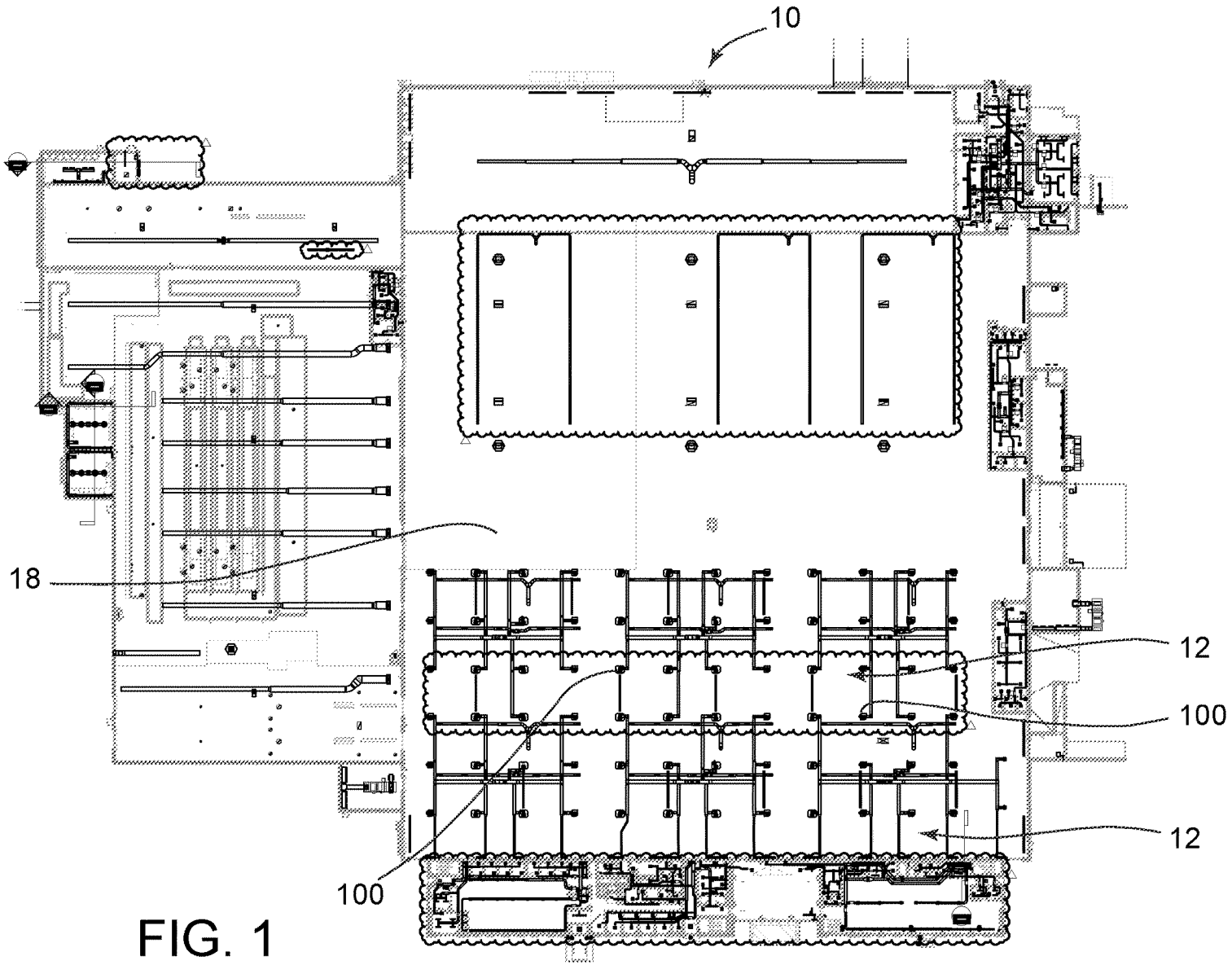
FIG. 1 is a top view of an example industrial workspace having designated work zones.
Figure 2:
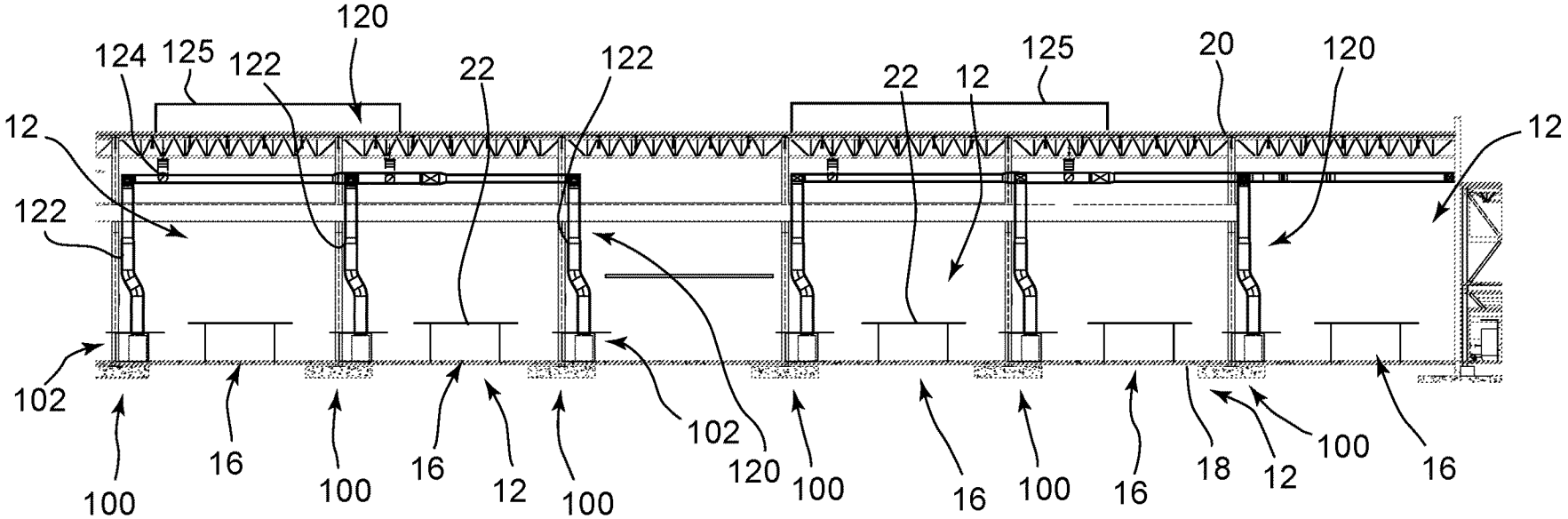
FIG. 2 is a first side view of the work zones of the industrial workspace shown in FIG. 1.
Figure 3:
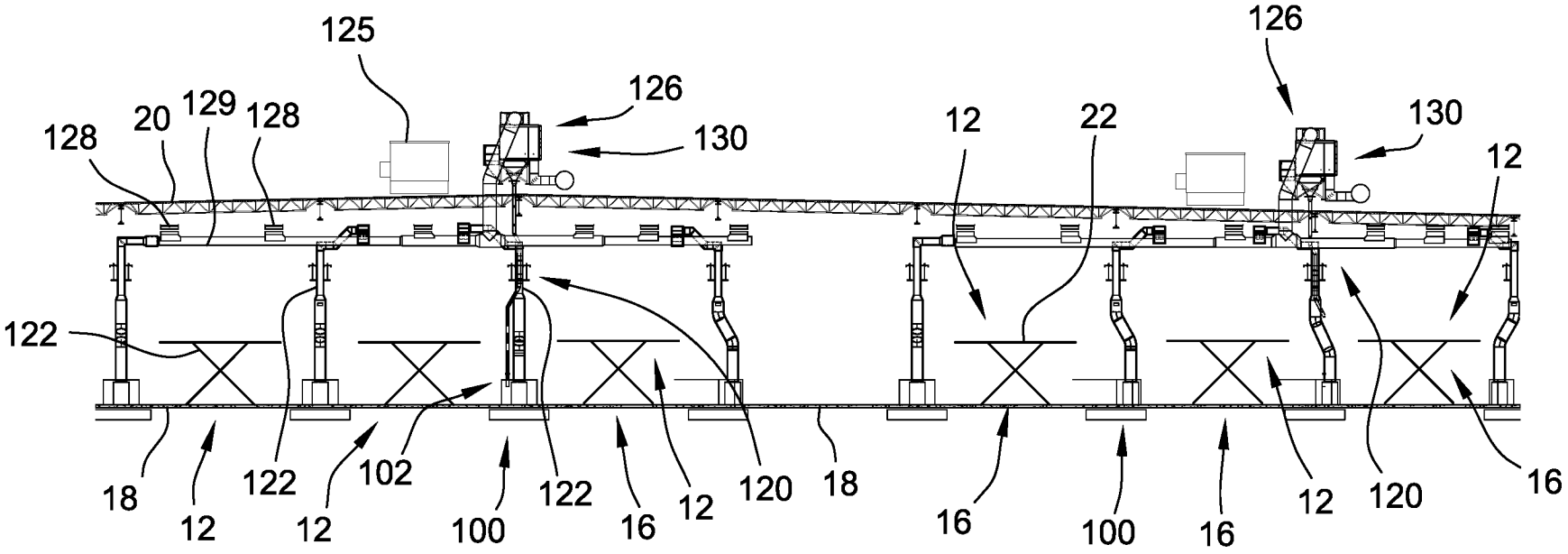
FIG. 3 is a second side view of the work zones of the industrial workspace.

Provisions of the present disclosure relate to manufacturing fixtures having a diffuser integrated therein for diffusing conditioned air into an industrial workspace such as a generally open factory layout in which one or more industrial operations are performed. An example industrial workspace 10 in which the fixture may be used is shown in FIG. 1. The industrial workspace 10 includes a plurality of work zones 12 which include a manufacturing fixture 100 having the diffuser integrated therein. Referring now to FIGS. 2 and 3, in the illustrated industrial workspace 10, each work zone 12 is a welding zone that includes a manufacturing fixture 100 in proximity to one or more welding stations 16 (e.g., welding table) within the zone 12.

During a welding operation, the ambient air adjacent the welding zone 12 is heated and contaminated with welding fumes. In accordance with embodiments of the present disclosure, the welding station 16 is in proximity to a manufacturing fixture 100 (e.g., a welding platform adapted for storing and securing welding equipment). The manufacturing fixture 100 includes a diffuser 102 (FIGS. 2-4) integrated in the fixture which diffuses conditioned air into the welding zone 12. This conditioned air displaces the heated and contaminated ambient air with reduced or no mixing with the contaminated ambient air and/or with less recirculation of the contaminated ambient air to other areas and/or zones outside of the designated work zone 12 within the industrial workspace 10.

Figure 4:
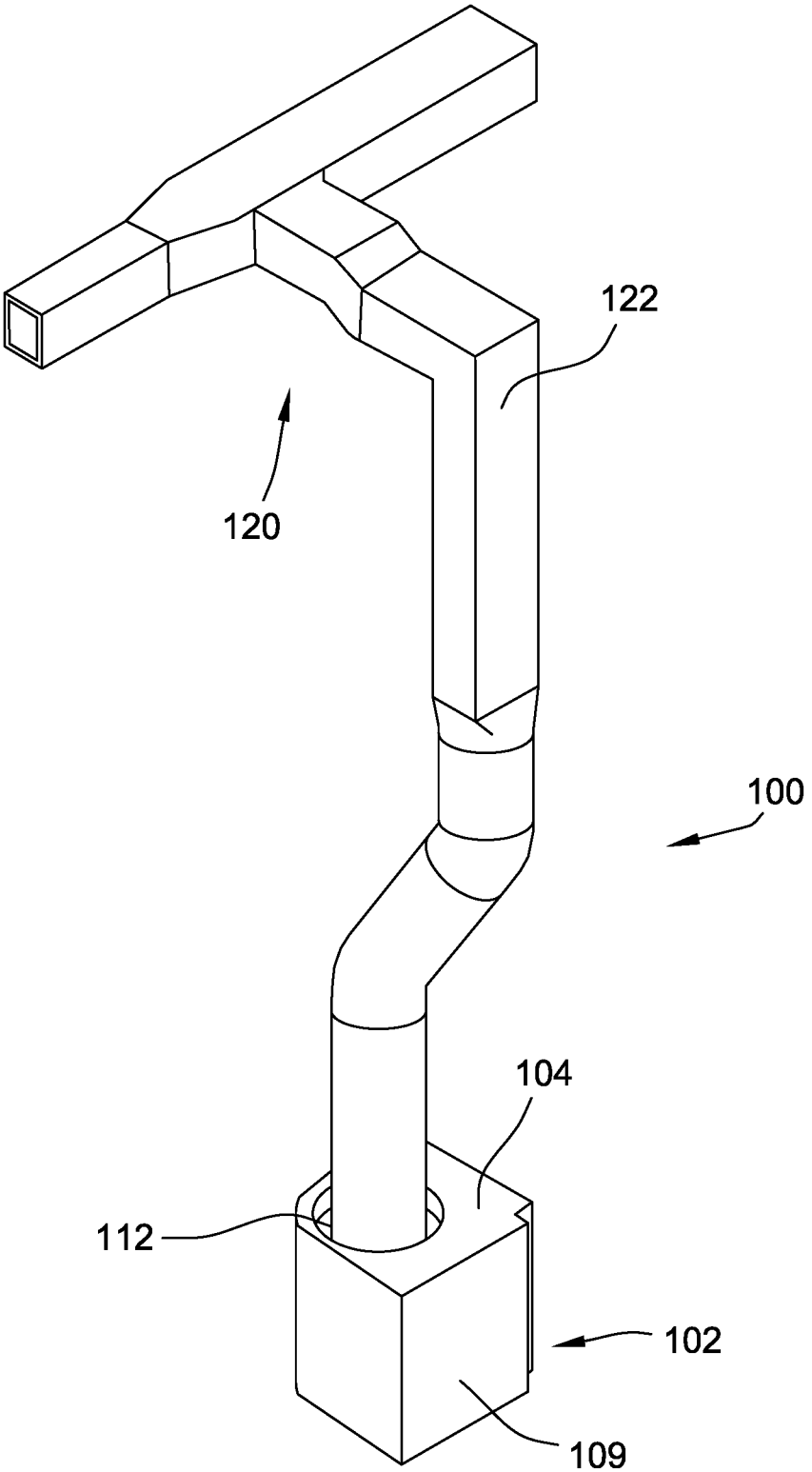
FIG. 4 is a perspective view of a vertical ventilation system that includes the manufacturing fixture having a diffuser integrated therein.

Referring now to FIG. 4, the manufacturing fixture 100 that includes a diffuser 102 integrated therein is part of a vertical displacement ventilation system 120 which diffuses conditioned air into the industrial workspace 10 and removes the contaminated ambient air. The manufacturing fixture 100 includes an elevated platform 104 and a diffuser deck 106 (also referred to herein as a vertical diffuser) mounted below the elevated platform 104. The elevated platform 104 has an air inlet 112 (FIG. 6) formed therein having an air inlet area $A_{112}$ (i.e., $\pi*r^2$ for circular openings with r being the radius of the opening).

The ventilation system 120 includes a supply duct 122 which is in flow communication with the diffuser deck 106. In some embodiments, the supply duct 122 forms the air inlet 112 in the elevated platform 104. In other embodiments, the supply duct 122 passes through the air inlet 112 formed in the elevated platform 104. In yet other embodiments, the supply duct 122 has an outlet separate from and disposed above the air inlet 112 formed in the elevated platform 104. In some embodiments, the supply duct 122 is connected to the elevated platform 104.

The supply duct 122 may be spaced a distance from the diffuser deck 106 (i.e., the uppermost plate 148 thereof) while maintaining flow communication (e.g., laminar flow) between the duct 122 and diffuser deck 106 (e.g., at least 1 inch, 2 inches, 6 inches, or 18 inches or more of spacing between a lower end of the supply duct 122 and the uppermost plate 148 of the diffuser deck 106). In other embodiments, the supply duct 122 is connected to the diffuser deck (i.e., without spacing between the supply duct 122 and diffuser deck 106). The supply duct 122 may have a length sufficient to create laminar air flow within the duct 122.

Figure 5:
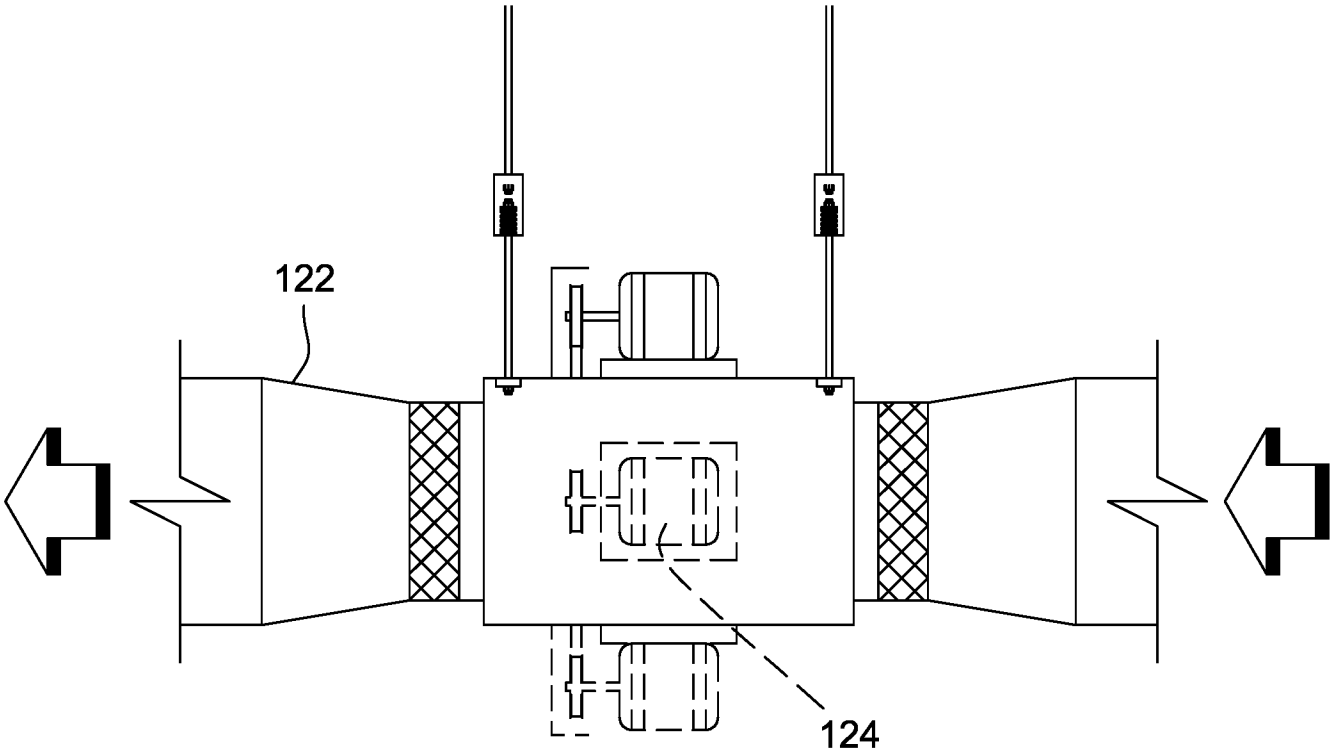
FIG. 5 is a side view of a portion of an exhaust for use with the vertical ventilation system.

The supply duct 122 may be fluidly connected with components associated with a heating, ventilation, and air conditioning system (HVAC) system that may be supported by the industrial workspace 10. The vertical displacement ventilation system 120 includes an air blower 124 (FIG. 5) that is fluidly connected to the supply duct 122 (FIG. 4). The air blower 124 is arranged to direct conditioned air through the supply duct 122 to the air inlet 112. The air blower 124 may draw conditioned air from a source such as an air conditioning (AC) system 125 (FIGS. 2-3) which supplies cooled air to the vertical ventilation system 120. In other embodiments, the exterior source may include air drawn directly from outside of the industrial workspace 10.

The manufacturing fixture 100 may be any suitable fixture used for an industrial operation, particularly for operations which generate heat and/or release fumes or contaminates polluting the surrounding ambient air. In addition, the manufacturing fixture 100 which integrates the diffuser 102 may be utilized for industrial workspaces 10 where there is limited available space on a floor 18 (FIGS. 2-3) of the industrial workspace 10.

In the illustrated embodiment, the elevated platform 104 is used to support industrial equipment 110 pertinent to an industrial operation. For example, the elevated platform 104 may support a welding unit, a welding boom arm, shelves, and/or welding cables. In some embodiments, the equipment 110 may include hand and power tools, personal protective equipment, tool box, small fixtures, and/or welding wire storage.

The manufacturing fixture 100 may be in proximity to a welding station 16 that includes a welding work surface, such as a welding table 22 as shown in FIGS. 2 and 3, or that includes a welding jig or booth. In some example embodiments, the welding table 22 is a lifting table i.e., including a scissor jack. The manufacturing fixture 100 may be adapted to support equipment for other industrial operations, such as equipment for grinders, mills, lathes, drills, laser or plasma cutting, oxy-fuel cutting, carbon air arc gouging, painting, 3-D printing or metal sintering/fusing processes, adhesive bonding and/or the like. The manufacturing fixture 100 may be adapted to support industrial operations that generate waste heat and air contaminates.

Figure 6:
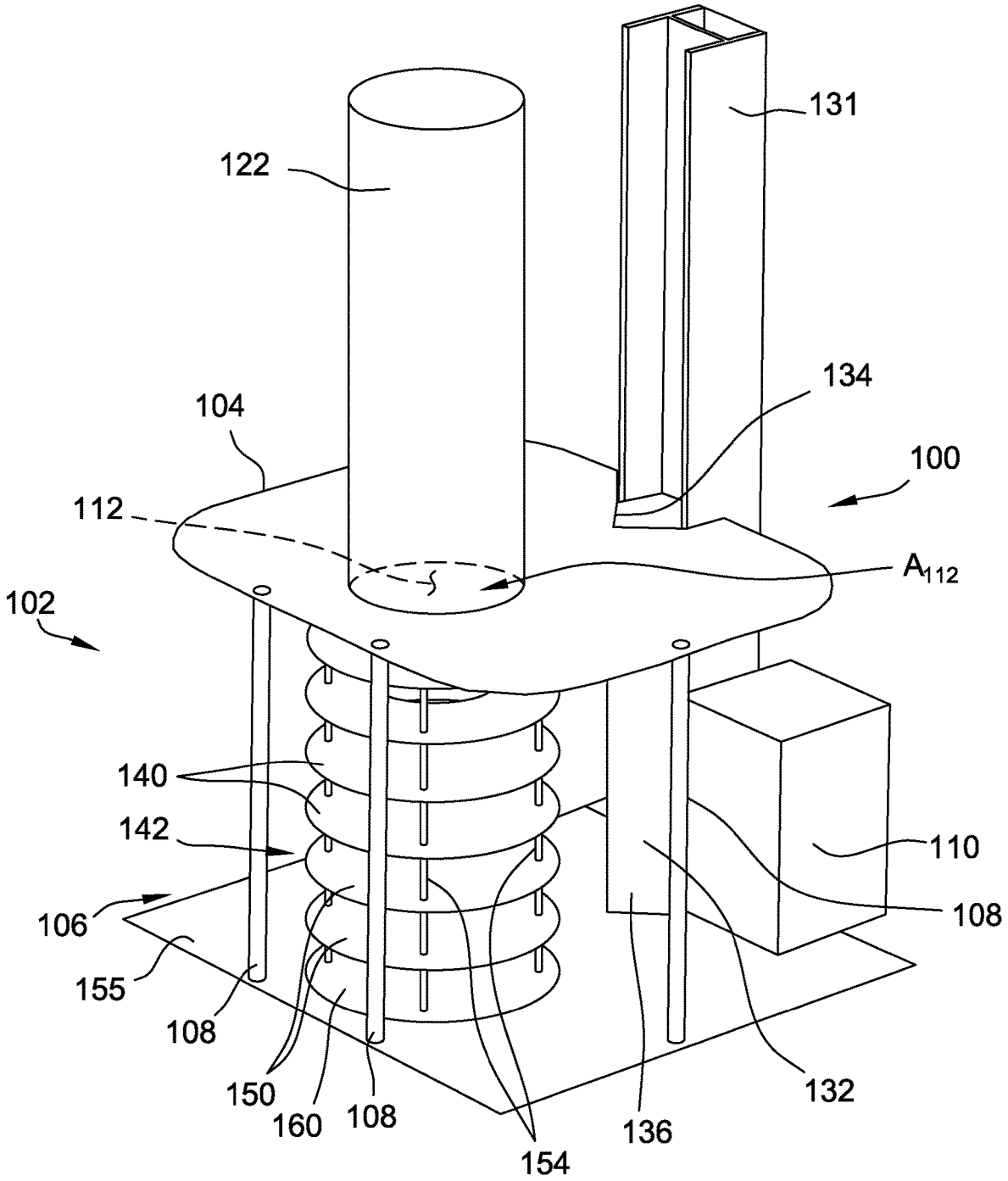
FIG. 6 is a perspective view of an example manufacturing fixture having an integrated diffuser.
Figure 7:
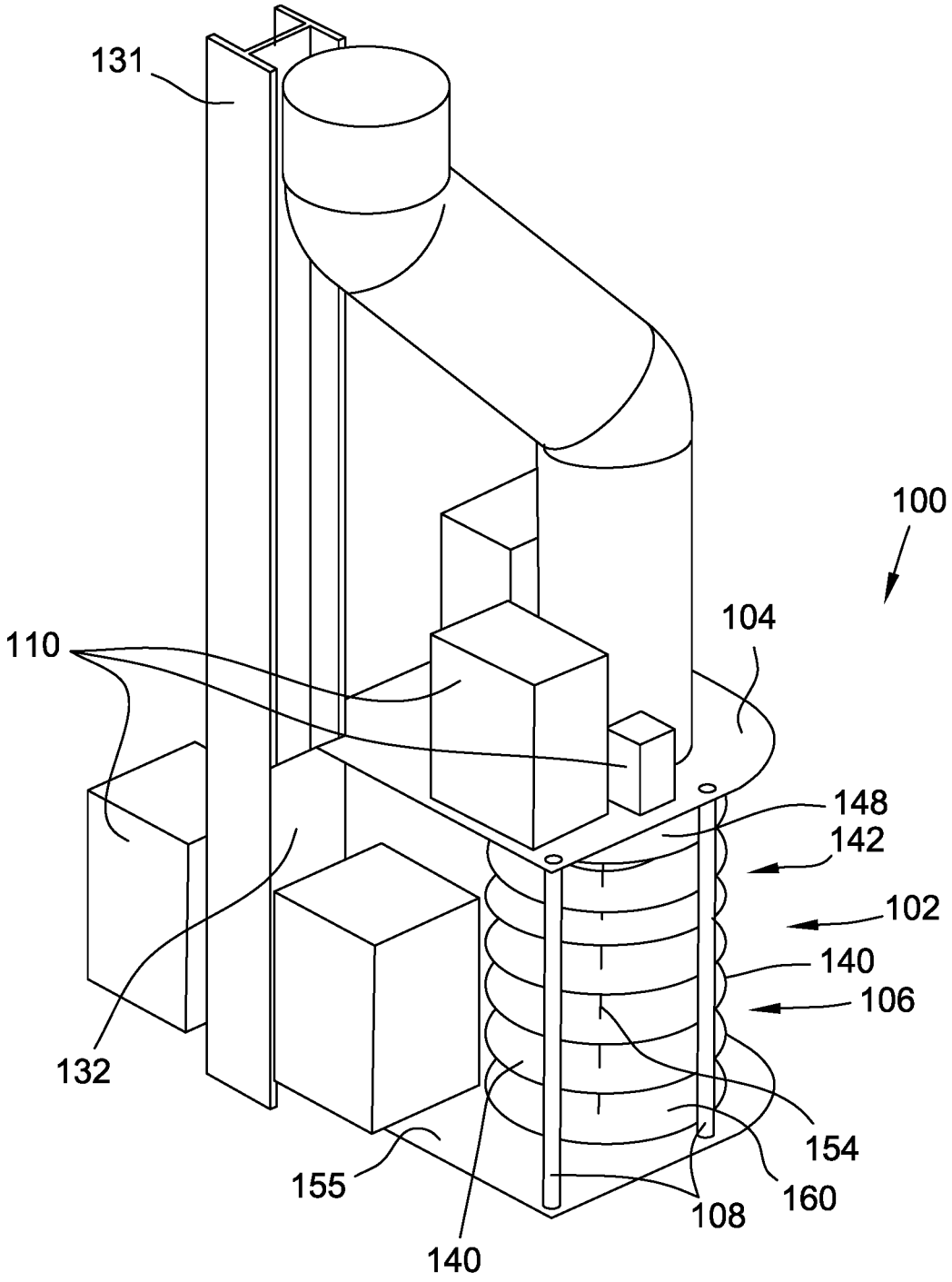
FIG. 7 is another perspective view of the manufacturing fixture having an integrated diffuser.
Figure 8:
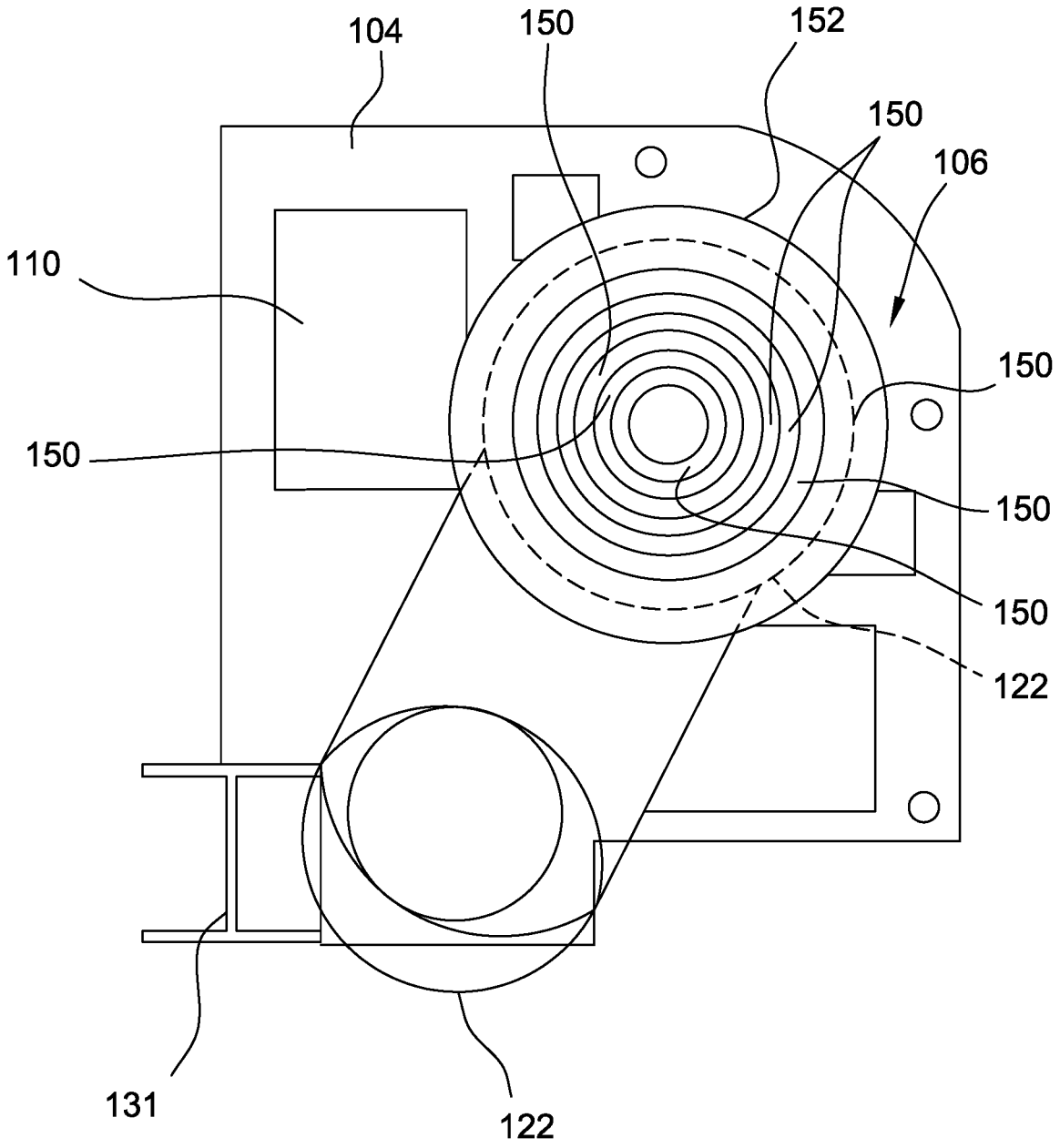
FIG. 8 is a top view of the manufacturing fixture having the integrated diffuser.

Referring now to FIGS. 6-8, the elevated platform 104 of the manufacturing fixture 100 is supported by one or more frame members 108. The diffuser deck 106 is disposed directly below the air inlet 112 and within the frame members 108. In some example embodiments, the frame members 108 may support a screen 109 (FIG. 4) which covers and/or protects at least a portion of the diffuser deck 106. In other embodiments, the integrated diffuser 102 does not include a screen. The diffuser deck 106 is arranged such that the diffuser deck 106 does not exceed a footprint of the elevated platform 104. In such embodiments, the diffuser deck 106 does not add an additional obstruction to available space on the floor 18 (FIGS. 2 and 3) of the industrial workspace 10.

In some embodiments, the elevated platform 104 is connected to a supporting structure 131 of the industrial edifice in which the manufacturing fixture 100 is disposed (e.g., an I-beam). The supporting structure 131 may also include a baffle 132 used to deflect conditioned air exiting the diffuser deck 106. The baffle 132 is used to reduce or prevent turbulence created as the conditioned air interacts with the supporting structure 131. The baffle 132 may be tent like in shape including a first panel 134 and second panel 136 angled relative to the first panel 134. In some embodiments, the baffle 132 is not mounted to the supporting structure 131, such that the baffle 132 is free standing and is placed in proximity to an obstruction to deflect airflow in a smooth manner around the obstruction.

The diffuser deck 106 is mounted below the elevated platform 104. The diffuser deck 106 includes a set of louver plates 140 arranged in a vertical stack 142. In this illustrated embodiment, the louver plates 140 are generally frustoconical in shape. Each of the louver plates 140 of the set includes an opening 144 (FIG. 9) having a centroid 146 and defining an opening plane $P_{144}$ (FIG. 10). The centroids 146 of each opening 144 of the louver plates 140 are positioned at a generally vertical louver axis $Y_{140}$. The opening planes $P_{144}$ are generally perpendicular to the louver axis $Y_{140}$. The opening 144 of an uppermost louver plate 148 has an area $A_{144}$ less than the area $A_{112}$ of the air inlet 112. The opening 144 of each subsequent louver plate 140 below the upper most louver plate 148 has an area less than the area of the louver plate 140 directly above. In the illustrated embodiment, the openings 144 are circular in shape such that a diameter $D_{144}$ of the opening 144 of each subsequent louver plate 140 below the upper most louver plate 148 has a diameter $D_{144}$ less than the diameter $D_{144}$ of the louver plate 140 directly above. In some embodiments, the opening 144 of the uppermost louver plate 148 has an area $A_{144}$ greater than and/or equal to the area $A_{112}$ of the air inlet 112. As air exits the supply duct 122 and passes through the air inlet 112, the conditioned air expands and creates an air plume. The air plume is introduced to the uppermost louver plate 148, and at least a portion of this air plume is deflected by the uppermost louver plate 148.

Each of the louver plates 140 includes a top surface 150. The top surface 150 of each louver plate 140 is angled downward from its opening 144. The top surface 150 and the opening plane $P_{144}$ of each louver plate 140 form an angle $\alpha$ from 10° to about 20° (e.g., from about 14° to about 16°). In some embodiments, the angle $\alpha$ is 15°.

Figure 9:
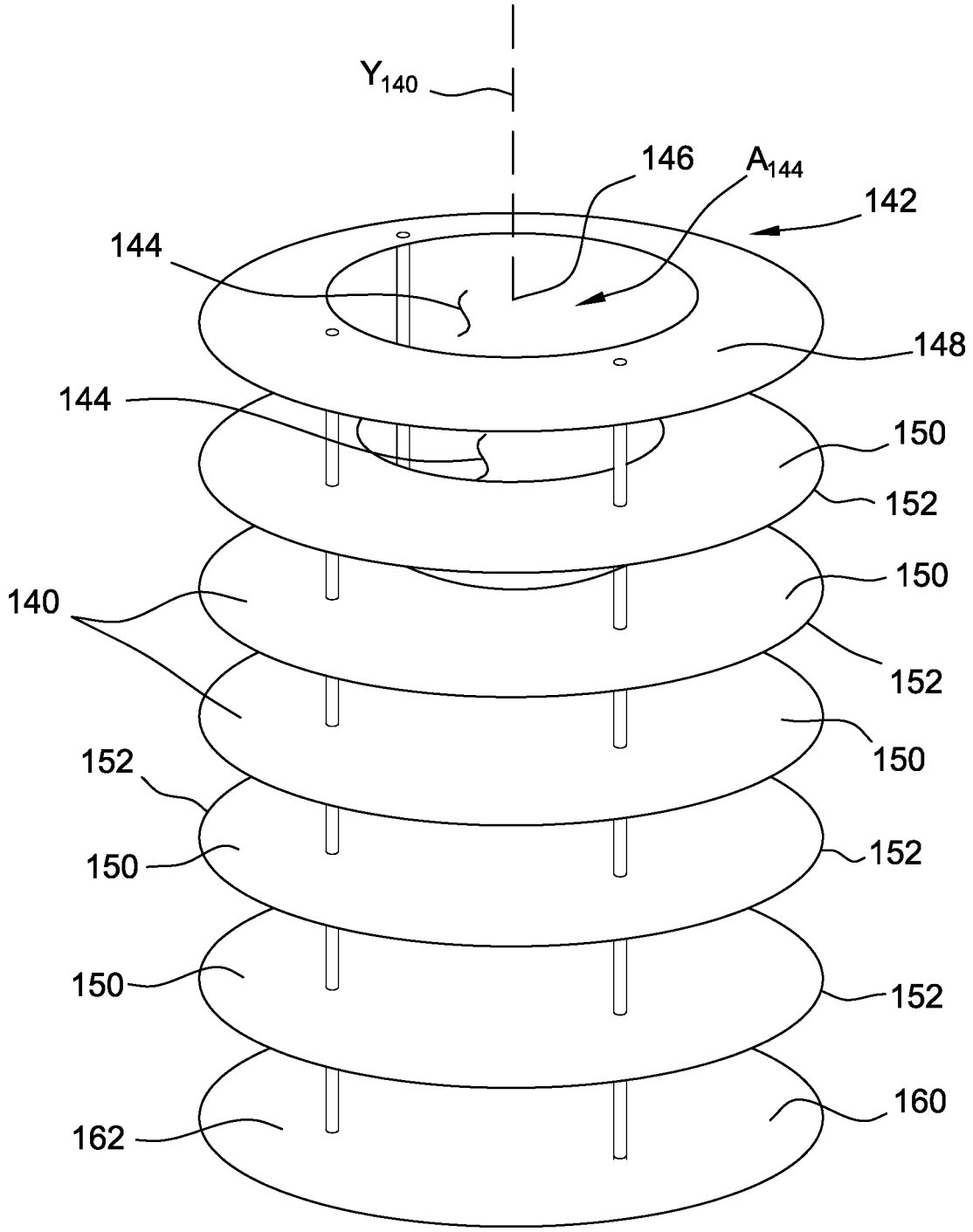
FIG. 9 is a perspective view of a diffuser deck of the manufacturing fixture.
Figure 10:
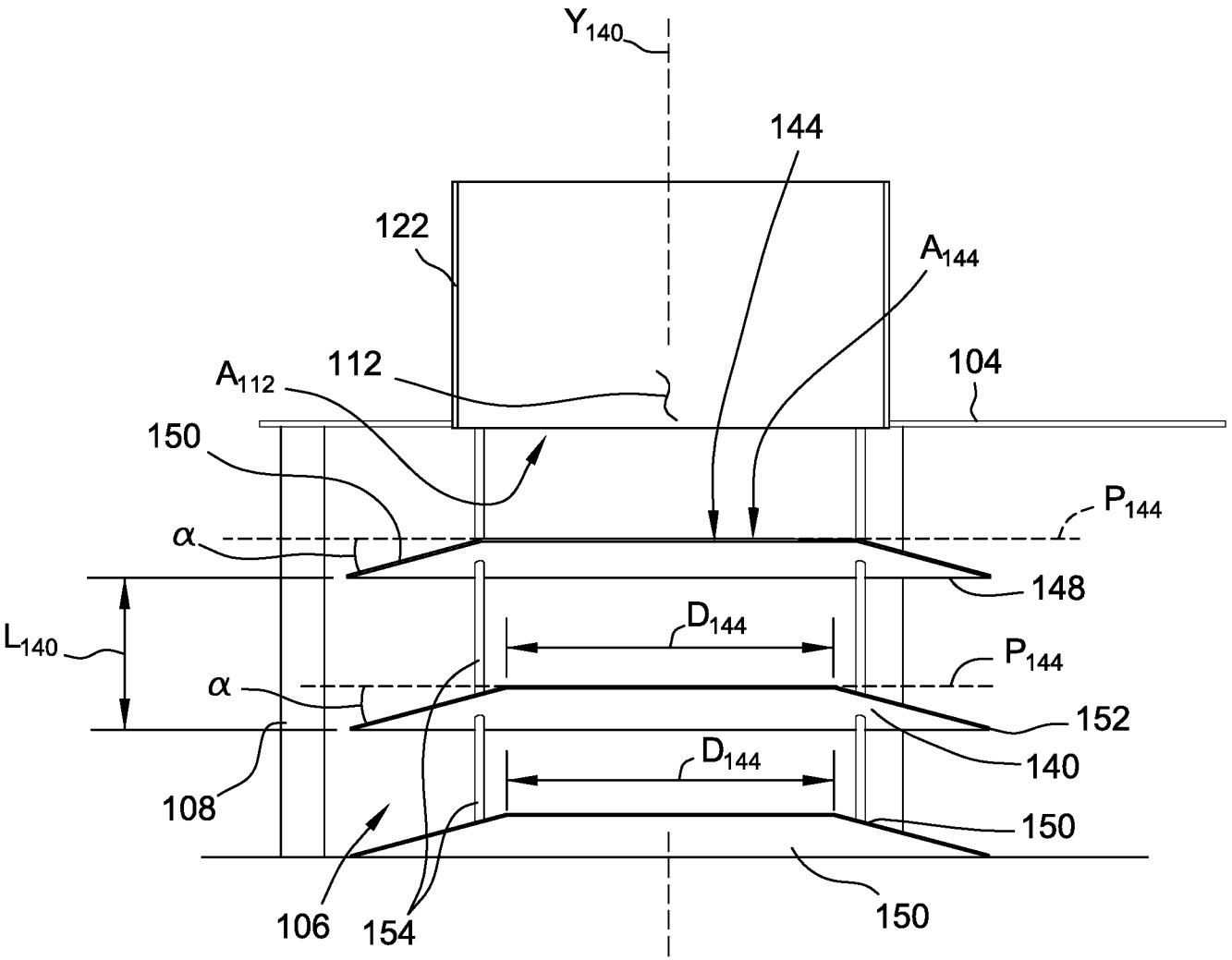
FIG. 10 is a detailed view of example louver plates of the diffuser deck.

Referring now to FIG. 9, the top surface 150 of each of the louver plate 140 further includes an outer perimeter 152. As shown in FIG. 8, the outer perimeter 152 of each of the louver plates 140 is aligned when viewed from above. In the illustrated embodiment, the outer perimeter 152 is generally circular in shape. In other embodiments, the outer perimeter 152 is asymmetric and/or the louver plates 140 have different dimensions and shapes enabling control of air defected by the top surface 150. For example, the louver plates 140 may include dimensions and shapes that bias the direction of the deflected air flow away from obstructions.

In some other example embodiments, the louver plates 140 are frustum in shape and the outer perimeter 152 is rectangular (e.g., square) in shape. Additionally, in some embodiments, the openings 144 of each louver plate may have a shape other than circular (e.g., rectangular).

Each of the louver plates 140 are spaced apart a distance $L_{140}$ (FIG. 10). The distance $L_{140}$ is at least 3 inches between each adjacent louver plates 140. In the illustrated embodiment, each of the louver plates 140 are arranged at consistent increments along the louver axis $Y_{140}$, such that the distance $L_{140}$ between louver plates 140 is generally equal. In other embodiments, the louver plates 140 are arranged at inconsistent increments along the louver axis $Y_{140}$. The distance $L_{140}$ may be adjusted to accommodate more or less air flow that is deflected by the top surface 150 between adjacent louver plates 140 such that the conditioned air is distributed without becoming turbulent.

The louver plates 140 are supported by a plurality of struts 154 (FIG. 6). The struts 154 are coupled to the elevated platform 104 and to a diffuser base 155. The struts 154 are arranged generally parallel to the louver axis $Y_{140}$. The struts 154 are coupled between adjacent louver plates 140 to maintain the distance $L_{140}$ between louver plates 140. The louver plates 140 are disposed within the frame members 108 which shield and protect the louver plates 140.

Generally, a portion of conditioned air is introduced to each louver plate 140 via the opening 144 and/or openings 144 formed on the louver plates 140 arranged above in the vertical stack 142 of the diffuser deck 106. The top surface 150 of each louver plate 140 deflects a portion of the conditioned air outwards towards the surrounding ambient air and the opening 144 allows a portion of the conditioned air to pass to the louver plate 140 arranged below.

The diffuser deck 106 includes a louver base plate 160 arranged at the bottom of the vertical stack 142. The louver base plate 160 does not have an opening 144 formed therein through which cool air passes. The louver base plate 160 includes a base plate surface 162 (FIG. 9) that deflects the conditioned air outward, away from the louver axis $Y_{140}$ toward the surrounding ambient air.

The deflected conditioned air exits the diffuser deck 106 at the outer perimeter 152 (FIG. 8) of each top surface 150 of each louver plate 140. Each deflected portion of conditioned air exits from each plate 140 in generally parallel directions. The velocity of the deflected portion of air that exits the diffuser deck 106 and enters the work zone 12 may be any suitable velocity that does not create turbulence. In some example embodiments, the velocity is from about 5 feet per minute to about 20 fpm at a distance of 20 feet away from the integrated diffuser 102. In some example embodiments, the velocity may be from 100 fpm to 150 fpm at a distance of 12 inches away from the integrated diffuser 102. In other example embodiments, the velocity of the deflected portion of the air is any suitable velocity that doesn't introduce turbulence (e.g., turbulence caused from air distributed by adjacent manufacturing fixtures 100). The velocity may vary along the length of the integrated diffuser 102.

In accordance with embodiments of the present disclosure, the conditioned air exits the diffuser deck 106 and may be introduced into the surrounding ambient air using laminar flow. The conditioned air does not substantially mix with the ambient air creating stratification between the conditioned air and the ambient air. The diffuser deck 106 may be configured to deliver conditioned air at laminar flow in about a region having a radius of about 20 feet from the diffuser deck 106.

In the illustrated embodiment, the diffuser deck 106 has a throw angle of 360° about the louver axis $Y_{140}$. More specifically, the integrated diffuser 102 introduces the conditioned air into the ambient air, in all directions surrounding the diffuser deck 106 (excluding obstructions).

The conditioned air exits the diffuser deck 106 and is introduced into the ambient air in a direction generally along the angled top surface 150 of the louver plates 140 such that the introduced conditioned air is directed substantially downwards towards the floor 18 of the industrial workspace 10. In some example embodiments, the conditioned air is introduced to the ambient air in a direction that is generally parallel to the opening planes $P_{144}$ and/or generally perpendicular to the louver plate axis $Y_{140}$.

The manufacturing fixture 100 is configured to be relatively simple to manufacture and install. For example, the diffuser deck 106 may lack components used for acoustic damping.

The manufacturing fixture 100 may be incorporated a vertical displacement ventilation system 120 (FIGS. 2-4). The industrial workspace 10 includes a roof 20 (FIGS. 2-3) that is disposed above the floor 18. The vertical displacement ventilation system 120 includes an exhaust system 126 (e.g., fan, filter system, cyclones and the like) for removing ambient air from the industrial workspace 10. The exhaust system 126 connects to an exhaust duct 129 having a plurality of exhaust duct inlets 128 that are disposed above the diffuser deck 106. The exhaust duct inlets 128 are arranged in proximity to the ceiling 20. The components of the exhaust system 126, (e.g., fan, filter system, cyclones and the like), are connected by ductwork and are arranged in any suitable location within and/or near the industrial workspace 10.

The manufacturing fixture 100 is arranged within an industrial edifice, also referred to as an industrial plant, having external walls (not shown). The exhaust system 126 includes an exhaust outlet 130 that is external to the industrial edifice. The exhaust system 126 removes ambient air and fumes from within the industrial workspace 10 by drawing in ambient air through the exhaust duct inlets 128 by an exhaust fan (not shown) and expelling the ambient air through the exhaust outlet 130. In some example embodiments, a portion of the exhausted air may be vented to an exterior of the industrial workspace and another portion may be filtered and then used for recirculation, i.e., re-supplied to AC system 125.

The conditioned air is introduced in proximity to the floor 18 such that the ambient air is displaced in a vertical direction toward the roof 20. More specifically, the conditioned air is cooler in temperature than the ambient air in the industrial workspace 10. The conditioned air may be at least 5° F., at least 10° F., or at least 15° F. cooler than the ambient air. Likewise, the conditioned air is denser than the ambient air containing fumes. The cooler, denser conditioned air displaces the hotter and less dense ambient air forcing the ambient air to rise in a vertical direction upward toward the roof 20. The vertically displaced ambient air is subsequently exhausted through the exhaust system 126. In other example embodiment, the conditioned air may be any suitable temperature such that the conditioned air is denser than the ambient air.

Accordingly, the vertical ventilation system 120 reduces or eliminates recirculation of the ambient air containing fumes with the conditioned air introduced into the work zone 12. In some example embodiments, the work zone 12 may have a slightly lower pressure, compared to the pressure of the surrounding industrial workspace 10, such that fumes created in the welding zone 12 are further contained within the welding zone 12 and prevented from mixing and contaminating the surrounding ambient air outside of the designated work zone 12. The lower pressure of the designated works zone 12 may also draw in fumes and ambient air from surrounding zones which will subsequently be displaced and expelled by the vertical displacement ventilation system 120.

The introduced conditioned air is subsequently contaminated and heated by additional welding processes or other industrial operations workspace and accordingly, the conditioned air becomes the ambient air containing fumes. New conditioned air introduced by the vertical displacement ventilation system 120 will continue to displace the contaminated air from within the welding zone. In this illustrated embodiment, the ventilation system 120 is capable of performing at least two air exchanges per hour, at an exchange rate of 2000 cubic feet per min (CFM). In some example embodiments, the exchange rate is 4000 CFM. The ventilation system 120 has the capacity to perform 4 to 5 air exchanges per hour.

Figure 11:
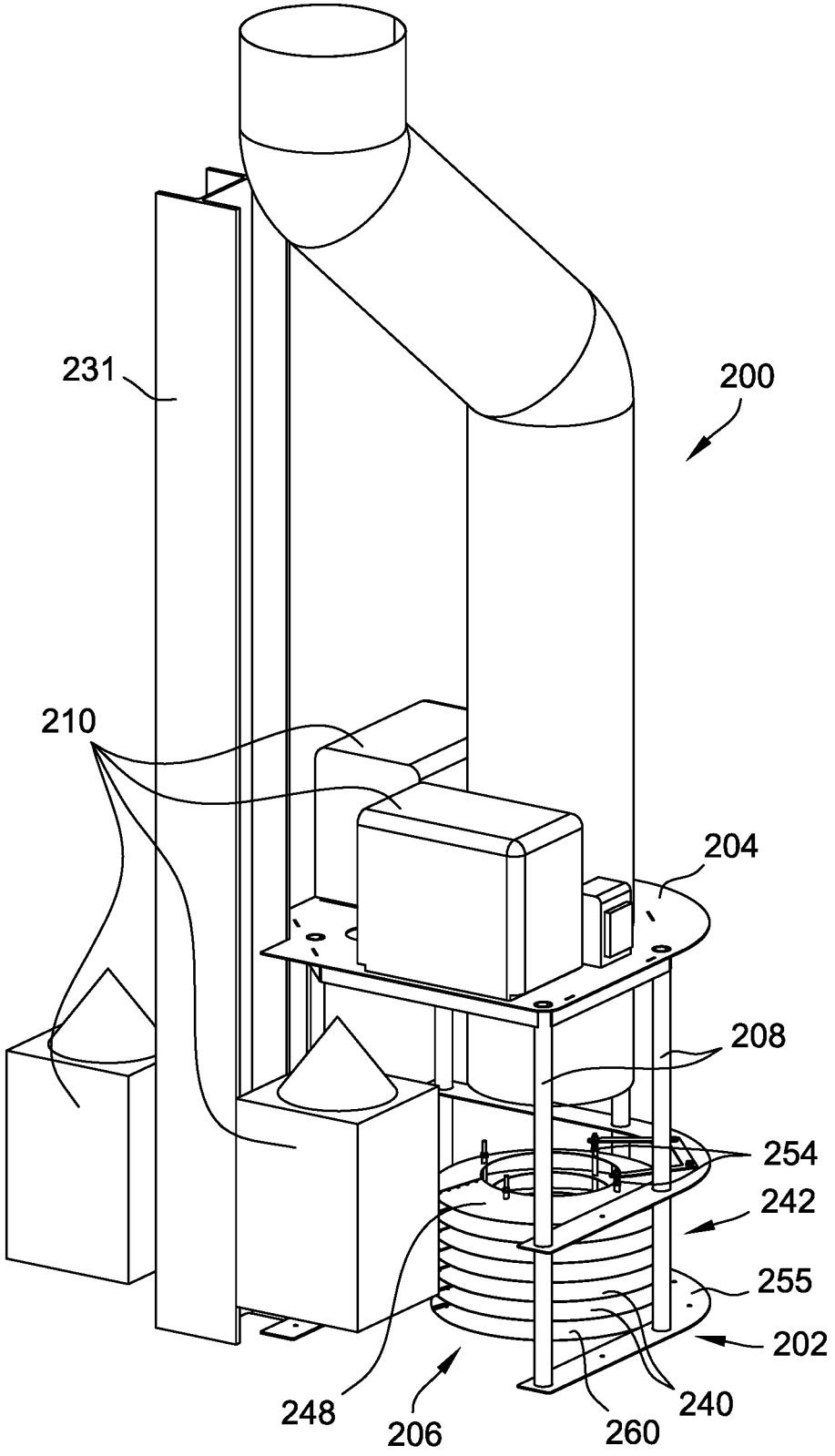
FIG. 11 is a perspective view of another embodiment of a manufacturing fixture having an integrated diffuser.
Figure 12:
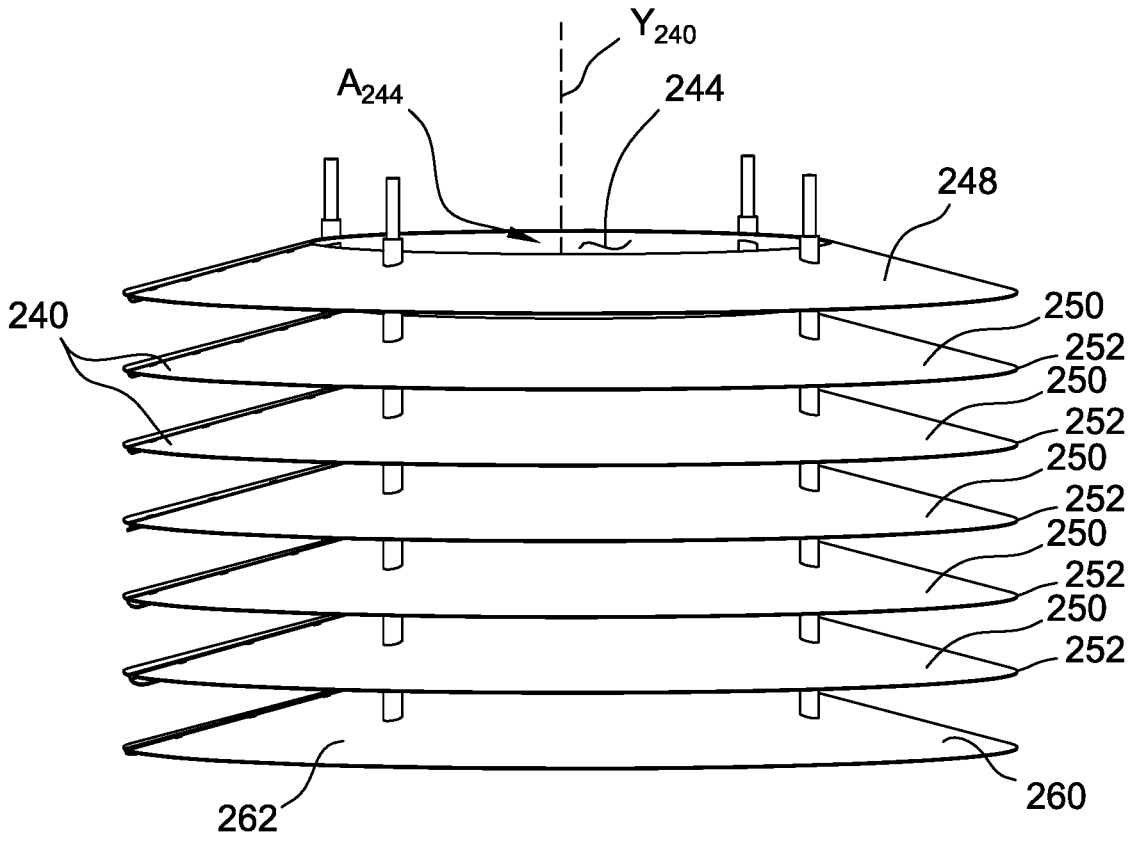
FIG. 12 is a perspective view of a diffuser deck of the manufacturing fixture of FIG. 11.
Figure 13:
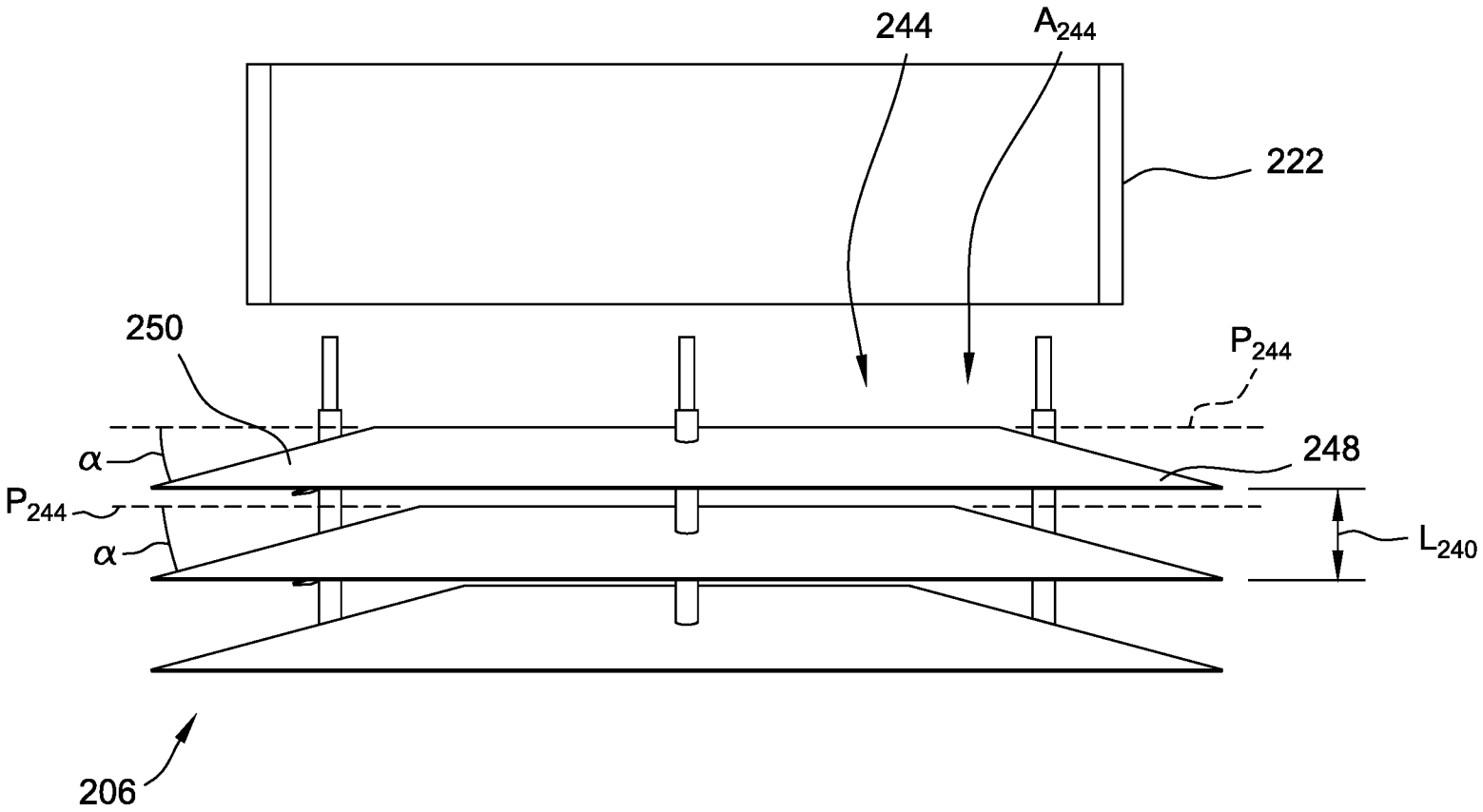
FIG. 13 is a detailed view of example louver plates of the diffuser deck of FIG. 12.

Another embodiment of the manufacturing fixture 200 is shown in FIGS. 11-13. The components shown in FIGS. 11-13 that are analogous to those of FIGS. 1-10 are designated by the corresponding reference number of FIGS. 1-10 plus "100" (e.g., part 106 becomes 206). In the embodiment of FIGS. 11-13, the spacing $L_{240}$ (FIG. 13) between the plates 240 of the diffuser deck 206 is tighter relative to the diffuser deck 106 of the embodiment illustrated in FIGS. 1-10. Otherwise, the fixture 200 may correspond to the fixture 100 described above.

Compared to conventional conditioning systems used for industrial workspaces, the conditioning systems of embodiments of the present disclosure have several advantages. By integrating the diffuser into a manufacturing fixture such as a welding station (e.g. elevated platform that supports the welding units), the integrated diffuser requires less space and does not create an obstruction within an industrial workspace. In addition, the manufacturing fixture may be used to perform an industrial operation that generates heat and/or contaminates which pollute the air surrounding the manufacturing fixture. The integrated system is capable of providing conditioned air, using laminar flow, in proximity to the floor, displacing the hot contaminated air localized near the integrated system without combining with the contaminated air and/or circulating the contaminated air throughout the rest of the industrial workspace. In embodiments wherein the integrated diffuser includes a plurality of louver plates each having an angled top surface, the diffuser is able to introduce conditioned air into the surrounding ambient air using laminar flow, i.e., with limited to no turbulence, creating stratification between conditioned air and contaminated ambient air. More specifically the conditioned air introduced by the integrated diffuser does not mix with the contaminated ambient air. The top surface of each of the louver plates may be angled (e.g., 10° to 20°) such that the conditioned air is deflected by the top surface and introduced into the surrounding contaminated ambient air at low velocities, preventing the conditioned air from displacing contaminated ambient air outward into surrounding zones of the industrial workspace. The angled top surfaces of the louver plates are arranged such that the conditioned air is introduced in proximity to the floor, displacing the contaminated air in a substantially vertical direction towards an exhaust inlet. Furthermore, the embodiments of the present disclosure include a robust design capable of withstanding environmental hazards, such as impacts and/or interaction with debris, common in an industrial workspace (e.g., impact with industrial mobile equipment such as lift truck or automated guide vehicles which may maneuver around the integrated diffuser). By incorporating the diffuser into the manufacturing fixture, conditioned air is introduced into the workspace in proximity to operators working within the industrial workspace.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing [s] shall be interpreted as illustrative and not in a limiting sense.

What is claimed is:

1. A manufacturing fixture having an integrated diffuser for diffusing conditioned air into an industrial workspace, the fixture comprising:

an elevated platform supported by frame members, the elevated platform having an air inlet formed therein having an air inlet area;

a diffuser deck mounted below the elevated platform and disposed directly below the air inlet, the diffuser deck being disposed within the frame members, the diffuser deck comprising a set of louver plates arranged in a vertical stack, each of the louver plates of the set having:

an opening having a centroid and defining an opening plane, wherein:

the opening of each subsequent louver plate below an uppermost louver plate has an area less than the area of the louver plate directly above; and the centroids of each opening of the louver plates are positioned at a generally vertical louver axis, the opening planes being generally perpendicular to the louver axis; and a top surface, the top surface of each louver plate being angled downward from the opening.

2. The manufacturing fixture as set forth in claim 1, wherein the diffuser deck comprises a louver base plate arranged at a bottom of the vertical stack, the louver base plate not having an opening formed therein through which cool air passes.

3. The manufacturing fixture as set forth in claim 1, wherein the each of the top surfaces of the louver plates includes an outer perimeter, the outer perimeters being aligned when viewed from above.

4. The manufacturing fixture as set forth in claim 1, wherein the each of the top surfaces of the louver plates includes an outer perimeter, at least a portion of the outer perimeters being asymmetrical to other outer perimeters.

5. The manufacturing fixture as set forth in claim 1, wherein each of the louver plates is frustoconical.

6. The manufacturing fixture as set forth in claim 1, wherein the top surface and opening plane of each louver plate form an angle from 10 to 20 degrees.

7. The manufacturing fixture as set forth in claim 1, wherein the top surface and opening plane of each louver plate form an angle from 14 to 16 degrees.

8. The manufacturing fixture as set forth in claim 1, wherein each of the louver plates are spaced at least 3 inches from each adjacent louver plate.

9. The manufacturing fixture as set forth in claim 1, wherein the diffuser deck does not exceed a footprint of the elevated platform.

10. A vertical displacement ventilation system for diffusing conditioned air into an industrial workspace, the system comprising:

a supply duct; and the manufacturing fixture of claim 1 disposed below the supply duct.

11. The vertical displacement system as set forth in claim 10 wherein the supply duct forms the air inlet formed in the elevated platform.

12. The vertical displacement system as set forth in claim 10 wherein the supply duct passes through the air inlet formed in the elevated platform.

13. The vertical displacement system as set forth in claim 10 wherein the supply duct has an outlet separate from and disposed above the air inlet formed in the elevated platform.

14. The vertical displacement system as set forth in claim 10 comprising an air blower fluidly connected to the supply duct.

15. The vertical displacement ventilation system as set forth in claim 10 comprising an exhaust disposed above the diffuser deck for removing ambient air and fumes from the industrial workspace, the exhaust having an inlet disposed above the diffuser deck.

16. The vertical displacement ventilation system as set forth in claim 10, the elevated platform being connected to a supporting structure of an industrial edifice in which the manufacturing fixture is disposed.

17. A method of dispelling ambient air containing fumes in an industrial workspace arranged within an open factory, the industrial workspace including a floor and a roof disposed above the floor, the method comprising:

directing a conditioned air stream from a supply duct to a vertical diffuser having a plurality of louver plates arranged in proximity to the floor;

introducing the conditioned air stream at a velocity less than 150 feet per minute at a distance of 12 inches away from the vertical diffuser by laminar flow into the ambient air containing fumes;

displacing the ambient air containing fumes by the laminar conditioned air flow such that the ambient air containing fumes is displaced upwardly in a vertical direction towards an exhaust duct inlet of an exhaust system, the exhaust duct inlet arranged in proximity to the roof; and exhausting the ambient air containing fumes through the exhaust system.

18. The method set forth in claim 17, wherein the conditioned air stream from the vertical diffuser is at a lower temperature and a higher density than the ambient air containing fumes in the industrial workspace, such that the cool air stream displaces the ambient air containing fumes and forces the ambient air containing fumes in a vertical direction.

19. The method as set forth in claim 17, wherein the conditioned air stream from the vertical diffuser is introduced into the industrial workspace at temperature at least 5° F. less than the temperature of the ambient air containing fumes.

20. The method as set forth in claim 17, wherein the conditioned air stream is contaminated and heated by a welding process to become ambient air containing fumes.

* * * * *